US005138998A

United States Patent [19]

Krieger et al.

[11] Patent Number: 5,138,998

[45] Date of Patent: Aug. 18, 1992

[54] DISTRIBUTION-TYPE FUEL INJECTION PUMP FOR INTERNAL COMBUSTION ENGINES

[75] Inventors: Klaus Krieger, Affalterbach; Karl Konrath; Carlos Alvarez-Avilla, both of Freiberg, all of Fed. Rep. of Germany

[73] Assignee: Robert Bosch GmbH, Stuttgart, Fed. Rep. of Germany

[21] Appl. No.: 687,908

[22] PCT Filed: Sep. 30, 1989

[86] PCT No.: PCT/DE89/00614

§ 371 Date: Jun. 5, 1991

§ 102(e) Date: Jun. 5, 1991

[87] PCT Pub. No.: WO90/07643

PCT Pub. Date: Jul. 12, 1990

[30] Foreign Application Priority Data

Dec. 31, 1988 [DE] Fed. Rep. of Germany ..... 3844452

[51] Int. Cl.[5] ..... F02M 39/00

[52] U.S. Cl. ..... 123/449; 123/373

[58] Field of Search ..... 123/449, 503, 365, 373, 123/366, 367

[56] References Cited

U.S. PATENT DOCUMENTS

| | | | |
|---|---|---|---|
| 4,414,945 | 11/1985 | Bonin | 123/373 |
| 4,509,470 | 4/1985 | Ito | 123/449 |
| 4,615,317 | 10/1986 | Bofinger | 123/449 |
| 4,703,730 | 11/1987 | Eheim | 123/449 |
| 4,920,938 | 5/1990 | Schwarz | 123/373 |
| 4,987,875 | 1/1991 | Hofer | 123/449 |
| 5,000,151 | 3/1991 | Eisele | 123/449 |
| 5,085,195 | 2/1992 | Yoshizu | 123/449 |

FOREIGN PATENT DOCUMENTS

| | | | |
|---|---|---|---|
| 2644994 | 4/1978 | Fed. Rep. of Germany . | |
| 148032 | 12/1982 | Japan . | |
| 2042072 | 9/1980 | United Kingdom . | |
| 2119962 | 11/1983 | United Kingdom | 123/373 |
| 2195472 | 4/1988 | United Kingdom . | |

*Primary Examiner*—Carl S. Miller

*Attorney, Agent, or Firm*—Edwin E. Greigg; Ronald E. Greigg

[57] ABSTRACT

A distributor-type fuel injection pump comprising a mechanical speed regulator in which a tension lever and a starting lever interact as a regulating lever system in such a manner that they act in combination above the idling speed. In such an arrangement a quantity control element is connected to the starting lever and, in addition, this starting lever is engaged by an idling spring. A pretension of the spring can be changed, in dependence on operating characteristics in order to obtain a corresponding change in the delivery quantity during idling, for example with idling overload.

25 Claims, 3 Drawing Sheets

DISTRIBUTION-TYPE FUEL INJECTION PUMP FOR INTERNAL COMBUSTION ENGINES

BACKGROUND OF THE INVENTION

Figure 1:
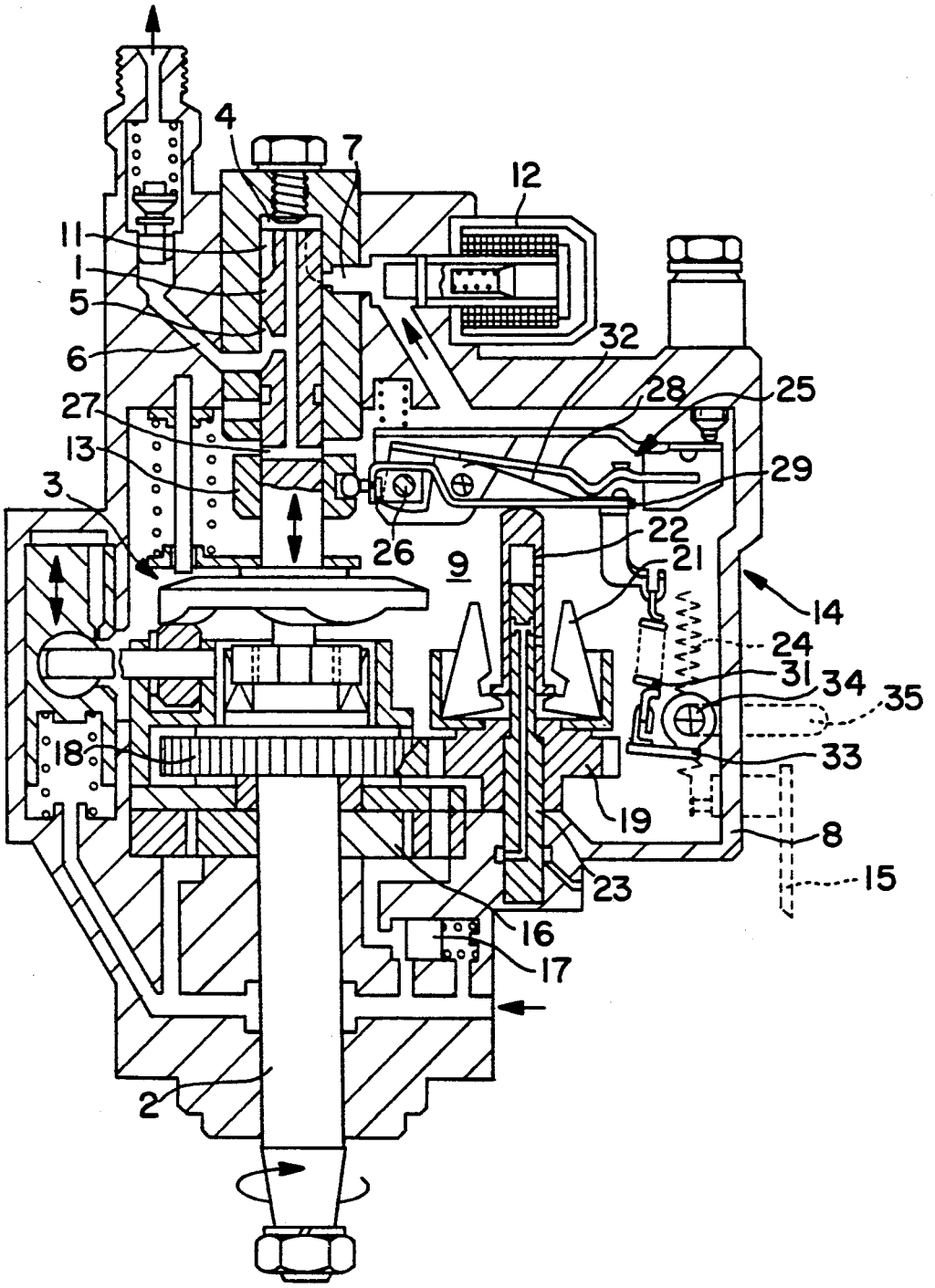

The invention is based on a fuel injection pump for internal combustion engines as set forth hereinafter. With the increasing use of the diesel engine, particularly in vehicles, the demand on the performance of a piece of injection equipment has also correspondingly risen. Not only are the exhaust gas values of the engine to be improved, but the combustion noises are to be reduced and a more advantageous driving characteristic is demanded, for example a largely uniform idling speed under changed driving conditions which occur when an air-conditioning system is additionally switched on or the engine is still cold. Such an idling load can lead, for example with a cold engine without additional facilities, to the stalling of the engine as the injected idling fuel quantity is too small. Thus, the injected quantity required for maintaining an adequate idling speed with a cold engine with additional idling load can be greater than the injected quantity required with a hot engine and full loading. On the other hand, the degree of nonuniformity during idling is high at the relatively low speeds so that differences of engine characteristics which affect the idling have a relatively great effect. In this connection, tolerances in the force of the idling spring or even pump frictions have a considerable effect on the quality of regulation of the idling so that it would be necessary to adjust the idling spring.

In a known fuel injection pump (German Offenlegungsschrift 35 00 341), the idling spring of the speed regulator is therefore suspended to be fixed to the pump housing with its end facing away from the regulator levers, the respective spring pretension being adjustable via an adjusting lever. This mainly achieves that the idling can be adjusted separately and very finely independently of the other regulator variables. The idling spring can be constructed to be very soft for its spring travel, which results in a lower degree of nonuniformity and it, above all, can be achieved that in overrun operation, when the vehicle pushes the engine and the gas peddle is in its zero position, a small quantity is always injected, that is to say the injected idling quantity is not also controlled to be zero. The main advantage of this is that when power is applied again, no "hole" occurs in the fuel supply which has an unpleasant effect, particularly in a diesel engine, since, due to the high compression of the diesel engine, a correspondingly high braking effect is produced by the engine on the vehicle when no fuel is supplied. This arrangement of the idling spring does not, however, eliminate the problem of increasing the injected quantity during cold idling.

In another known fuel injection pump of a similar type (German Offenlegungsschrift 28 44 910), the fuel injection pump regulation is acted upon via a temperature transmitter, the control variable of which is the cooling-water temperature of the internal combustion engine, the idling speed being regulated in such a manner that it decreases with increasing temperature. For this purpose, the pretension of the idling spring is changed by a stop, which determines the spring pretension, being changed by the temperature transmitter. Since the idling spring and the actual regulating spring in this regulator are connected in series, with appropriate limitation to the travel of the idling spring, either the initial position of a rotating lever, which engages the tension lever via a starting lever and is used for shutoff, or the point of suspension of the regulating spring or the initial position of the adjusting lever pretensioning the regulating spring can be changed via the temperature transmitter. Whilst the possible lever travel of the shutoff lever is reduced with increasing temperature, this travel is increased with increasing temperature in the case of the adjusting lever. As a result, the idling spring is relieved more with increasing temperature by the latter in the zero position. Due to the greater relief, the cut-off speed is set to a lower speed in idling and, respectively, causes a reduction in the fuel quantity to be injected.

This latter known regulating system, however, has the disadvantage, initially mentioned, of a high proportionality factor with a relatively hard spring (very short spring travel) and with fuel delivery which is interrupted in overrun operation.

ADVANTAGES OF THE INVENTION

By comparison, the fuel injection pump according to the invention has the advantage that, whilst retaining the advantages occurring in the generically known fuel injection pump, the increase in fuel required for a uniform idling speed when additional units are added or when the internal combustion engine is cold can be achieved without problems. This adaptation of the idling quantity to the required operating characteristics is effected without other disadvantageous interventions in the speed regulator.

In accordance with an advantageous development of the invention, the adjusting lever of the idling spring is arranged at one front end of a torque shaft supported in the pump housing, at the other end of which, on the outside of the pump housing, an external idling lever is attached which can be rotated by an adjusting element operating in dependence on an engine characteristic. Although it is basically known to provide such torque shafts for levers existing inside and outside the pump housing (see above prior art), the known regulators are necessary interventions for load input such as, for example, changing the pretension of the regulating spring via the adjusting lever operated by the driver or, for example, load-pressure-dependently changing a quantity stop of the regulator levers but not for changing the pretension of the idling spring because the basic adjustment, once it has been made, should no longer be changed in the device which — as stated above — is extremely critical for the idling quality.

According to a further advantageous development of the invention, the range of rotation of the adjusting lever can also be determined by stops of the idling lever which can be adjusted outside the pump housing.

According to a further advantageous development of the invention, a solenoid is used as an adjusting element. The adjusting lever is rotated by a solenoid from one stop position into the other one so that only two pretension situations of the idling spring are always given. In addition, a solenoid can be easily controlled in that its current supply is released in dependence on some engine characteristics. This can be done, for example, with the switching-on of an air-conditioning unit or via a temperature-dependently operated wax switch. The advantage also consists in that further required switches operating in dependence on operating characteristics can be arranged in parallel in such a circuit.

According to the invention, however, it is also possible to adjust the idling lever by only a particular distance which corresponds to the respective additional idling load such as, for example, the respective engine temperature. This can be done, for example, by means of temperature-dependently limiting the range of rotation, that is to say changing one stop.

According to an advantageous development of the invention, a barometric cell can be used as an adjusting element which is operated by a control air which exhibits operating pressure, in which connection, for example, this control air exhibits a negative pressure from the braking circuit of the vehicle.

According to a further advantageous development, a solenoid valve is arranged in the feed line of the control air which can be driven in dependence on engine characteristics. As in the case of driving a solenoid, the advantages of the electric circuit are brought to bear in this case.

In accordance with a further advantageous development of the invention, a Bowden cable is used as transmission means between the solenoid or barometric cell and idling lever.

Further advantages and advantageous developments of the invention can be found in the subsequent description, the drawing and the claims.

DRAWING

An illustrative embodiment of the subject matter of the invention is shown in two variants in the drawing and described in greater detail in the text which follows, FIG. 1 shows a distributor-type fuel injection pump in longitudinal section.

Figure 2:
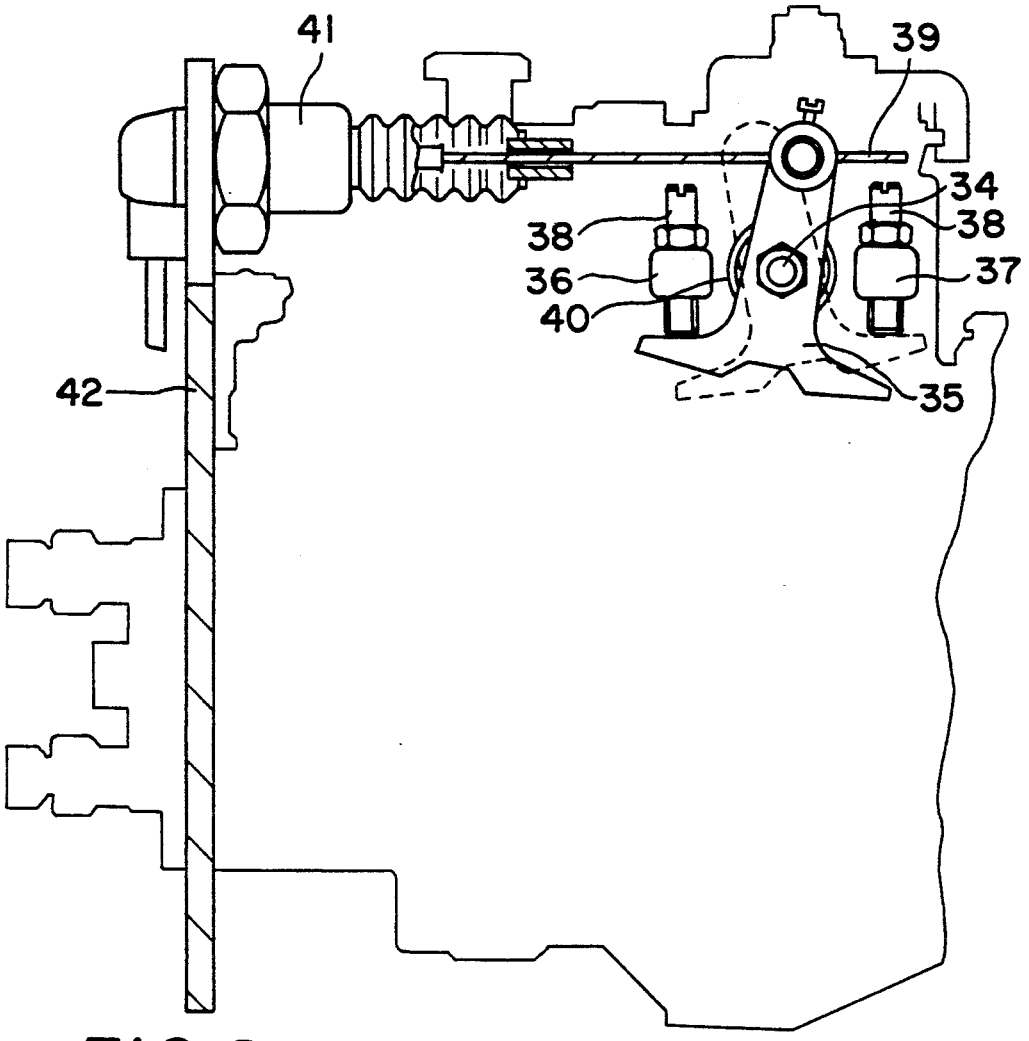
Figure 3:
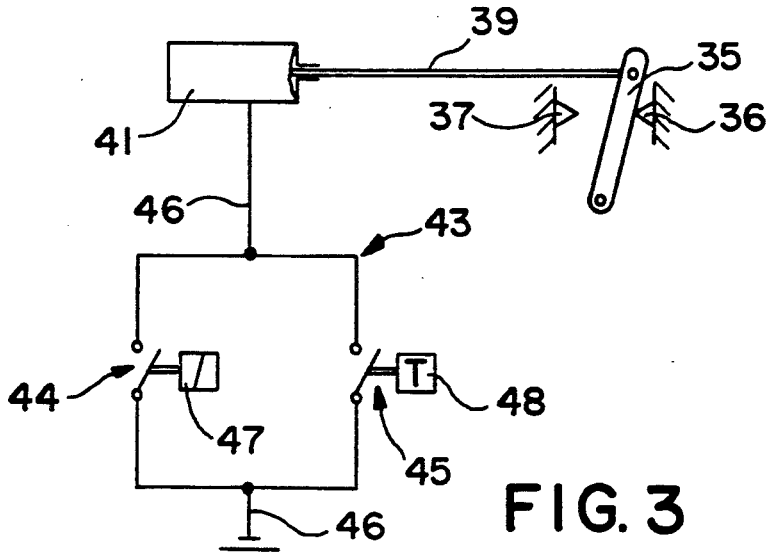
Figure 4:
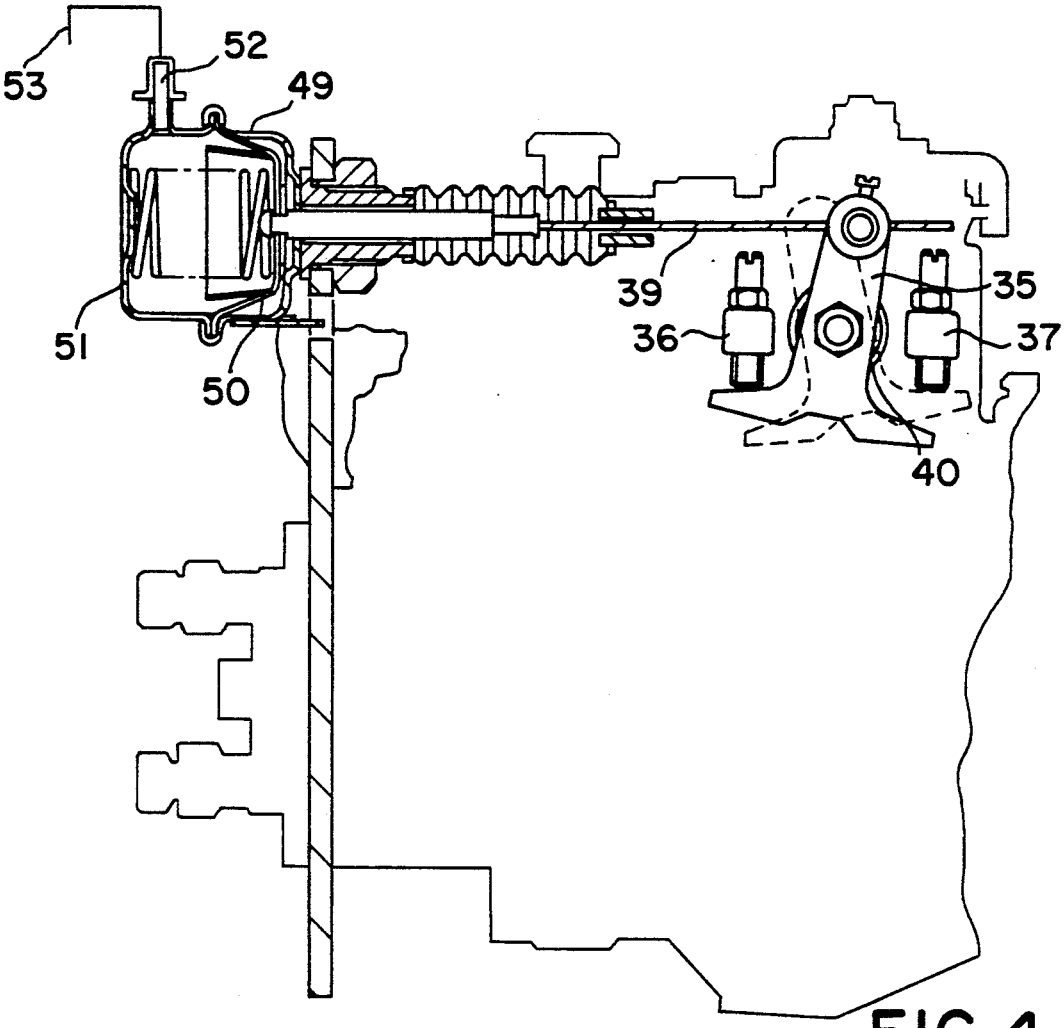
Figure 5:
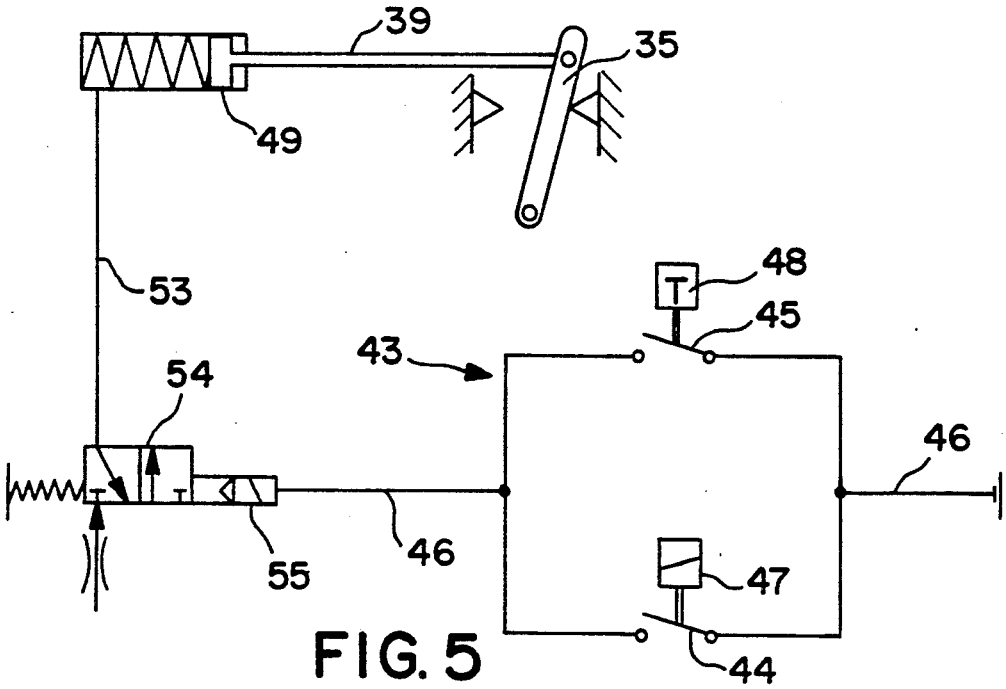

FIGS. 2 and 3 show the first variant with idling lever operation by means of a solenoid and FIGS. 4 and 5 show the second variant with idling lever operation via a barometric cell.

DESCRIPTION OF THE ILLUSTRATIVE EMBODIMENT

In the distributor-type injection pump shown in longitudinal section in FIG. 1, a pump piston 1, which is also used as a distributor, is put into a reciprocating and at the same time rotating motion by means of a drive shaft 2 and with the aid of a cam drive 3. In this arrangement, fuel is delivered with each pressure stroke of the pump piston 1 from a pump workspace 4 via a longitudinal distributor slot 5 to one of several pressure ducts 6 which are arranged at uniform distances of rotational angle around the pump piston 1 and in each case lead to a combustion space, not shown, of an internal combustion engine.

The pump workspace 4 is supplied with fuel via a suction duct 7 from a suction space 9 existing in the pump housing 8 of the injection pump and filled with fuel, in that the suction duct 7 is opened by longitudinal control slots 11 provided in the pump piston 1 during the suction stroke of the pump piston 1. The number of longitudinal control slots 11 corresponds to the number of pressure ducts 6 and thus to the number of pressure strokes carried out per revolution of the pump piston 1. In the suction duct 7, a solenoid valve 12 is arranged which blocks the suction duct 7 for ending the injection so that no fuel can reach the pump workspace 4 from the suction space 9 during the suction stroke of the pump piston 1.

The quantity to be injected, which is delivered into one each of the pressure ducts 6 per stroke is determined by the axial position of a regulating slide valve 13 arranged about the pump piston 1. This axial position is determined by a speed regulator 14 and an arbitrarily operable adjusting lever 15 with evaluation of the engine characteristics, speed and load.

The suction space 9 is supplied with fuel from a delivery pump 15 which is driven by the drive shaft 2. The initial pressure of the delivery pump 16, and thus the pressure in the suction space 9, is controlled by a pressure control valve 17 in such a manner that this pressure increases with increasing speed.

The speed regulator is driven via a toothed wheel 18 which is connected to the drive shaft 2 and drives a speed transmitter 19 with the flyweights 21 which engage one side of a regulator sleeve 22 which is axially displaceably supported on a shaft 23 and the other end of which is engaged by the regulating lever system 25, which is loaded by a regulating spring 24 and which acts as a pivot for the regulating slide valve 13 for its stroke position. For this purpose, the regulating lever system 25 is rotatably supported on a shaft 26. The pre-tension of the regulating spring 24 can be changed by the adjusting lever 15 in such a manner that when the adjusting lever 15 is adjusted in the direction of increasing load, the pre-tension of the regulating spring 24 also increases so that the regulating slide valve 13 is pushed further towards the top, which due to a resultant later opening of a relief duct 27 of the pump work space 4 during the pressure stroke of the pump piston 1 results in an increase in the injected quantity. The fuel quantity still located in the pump work space 4 is cut off whenever during the pressure stroke of the pump piston 1 and thus further fuel is delivered by the pump piston 1 into the suction space 9.

In the regulating lever system 25, two regulator levers are supported on the shaft 26, namely the tension lever 28 which is engaged by the regulating spring 24 and an idling spring 31, and a starting lever 29. Between the two levers, a starting spring 32 is provided which presses apart the two levers and which displaces the regulating slide valve 13 as far as possible towards the top when the engine is stopped, which corresponds to a maximum fuel delivery quantity, a so-called additional starting quantity. As soon as the internal combustion engine is then started, the regulator sleeve 22 is pushed by the flyweights 21 against the starting lever 29 and rotates the latter against the force of the starting spring 32 into the position shown in which the starting lever 29 and tension lever 28 rest against one another. The starting spring 32 is thus eliminated. During the subsequent displacement in dependence on speed and load, the previously assumed extreme position for the additional starting quantity will be no longer achieved by the regulating slide valve 13.

The idling spring 31 is not effective at starting speeds — it is too relaxed and becomes effective only when the idling speed is reached before the regulating spring 24 then becomes effective for the actual cut-off after the two levers have come to rest against one another. Due to the regulating spring 24, the desired speed is then regulated in the all-speed regulator but the cut-off effected in the idling speed regulator, in the manner known for such mechanical speed regulators.

The idling spring 31 is suspended at the end facing away from the starting lever 29 on an adjusting lever 33 which can be rotated via a torque shaft 34, which is supported in the pump housing 8, by an idling lever 35 which is accessible outside the pump housing 8 and is attached to the torque shaft 34 (the idling lever 35 is only shown dot-dashed in FIG. 1 since it is arranged in the space in front of the section as shown in FIG. 2). The rotating of the adjusting lever 33 changes the pretension of the idling spring 31 which, in the idling speed range, leads to a rotation of the starting lever 29 and thus of the regulating slide valve 13 at a particular idling speed, in such a manner that when the spring tension is increased, the regulating slide valve 13 is pushed towards the left into a position for a greater injected quantity and, conversely, is pushed into a position for a lower delivery quantity with decreasing spring tension.

FIG. 2 shows a detail of the external view of the pump according to FIG. 1, in which, in particular, the idling lever 35 is emphasized. The range of rotation of the idling lever 35 and thus, naturally, also of the adjusting lever 33 is limited by stops 36 and 37 which can be adjusted by means of adjusting screws 38. A leg spring 40 engages the idling lever 35 in the direction of a lower injected quantity. The idling lever 35 is shown in the rotational position for normal idling speed, that is to say lower injected quantity, whilst the position in which an increased fuel quantity is delivered during idling is indicated dashed.

The idling lever 35 is engaged by a Bowden cable 39 which leads to an electromagnet 41 as adjusting element and which is attached to a plate 42 of the pump housing 8. As soon as the electromagnet 41 is excited, the idling lever 35 is rotated into the position shown dashed, that is to say a position for a greater injected quantity during idling or, respectively, a higher idling speed.

FIG. 3 shows the electric circuit diagram 43, belonging to this variant of the illustrative embodiment, for the electromagnet 41 in which two electric switches 44 and 45 are arranged in parallel in the current line 46 of the electromagnet 41. The switch 44 is operated by a solenoid 47 which is switched by additional units such as, for example, an air-conditioning system. The switch 45, in contrast, is operated by a temperature-dependently operating actuator 48 which is controlled by the cooling-water temperature of the engine. In this manner, the electric switch 44 is closed by the solenoid 47 when an additional unit is taken into operation whereupon the electromagnet 41 is then excited and rotates the idling lever 35 to the stop 37, with the consequence that the injected idling quantity is additively increased. The switch 45, in contrast, is closed with a cold internal combustion engine and opens via the actuator 48 as soon as the internal combustion engine is heated up. However, as long as the switch 45 is closed, that is to say when the internal combustion engine is cold, the electromagnet 41 is excited and an increase in the injected quantity is achieved in the idling range via the idling lever 35 and the corresponding increase in pretension of the idling spring 31.

In the variant of the illustrative embodiment shown in FIG. 4, the idling lever 35 is rotated from the stop 36 to the stop 37 by means of the Bowden cable 39 when the latter is operated when a corresponding negative pressure has been reached by a barometric cell 49. This barometric cell exhibits a control diaphragm 50 and a restoring spring 51, and a connecting stop 52 from which a feed line 53 leads to a negative-pressure area of the internal combustion engine, for example in the brake area. As soon as an adequate negative pressure is set in the barometric cell 49 via the feed line 53, the diaphragm 50 is displaced towards the left in opposition to the restoring spring 51 and rotates the idling lever 35 into the dashed position for greater injected quantity via the Bowden cable 39.

FIG. 5 shows a circuit diagram for this variant in which in the feed line 53 a solenoid valve 54 is arranged which can be driven via an electric circuit 43. This electric circuit operates in the same manner as the circuit shown in FIG. 3, where in this case the actuating magnet 55 of the solenoid valve 54 is electrically driven instead of the electromagnet 41 driven there.

All features shown in the description, the subsequent claims and the drawing can be essential to the invention both individually and in any combination with one another.

The following relates to a preferred exemplary embodiment of the invention, it being understood that other variants and embodiments thereof are possible within the spirit and scope of the invention, the latter being defined by the appended.

We claim:

1. A distributor-type fuel injection pump for internal combustion engines comprising a pump piston driven in a reciprocating and at the same time rotating motion by means of a cam drive, with an annular control slide valve arranged axially displaceably on the pump piston for controlling the injected quantity, a regulating lever system which exits for the load and speed-dependent displacement of the control side valve and including a tension lever which is rotated around an axis and is loaded by a cut-off spring, a pretension of said spring is changed by means of an adjusting lever, a starting lever which is rotatable around the same axis and including a starting spring with the tension lever forming a lever combination above the idling speed which starting lever is coupled to the contol slide valve by means of a carrier element and which is engaged by an idling spring which also engages an adjusting lever which rests against a first stop which can be adjusted for changing the spring pretension of the idling spring, the adjusting lever (33) can be rotated in dependence on operating characteristics (47, 48) and the final position of rotation assumed after rotation depends on engine characteristics limited by a second stop (37) which is always adjustable.

2. A distributor-type fuel injection pump according to claim 1, in which the adjusting lever (22) is arranged at one front end of a torque shaft (34) which is supported in the pump housing (8) and the other end of which is engaged outside the pump housing (8) by an external idling lever (35) which is rotated by an adjusting element (41, 49) which operates in dependence on operating characteristics.

3. A distributor-type fuel injection pump according to claim 2, in which the range of rotation of the adjusting lever (33) can be determined by stops (36, 37, 38) of the idling lever (35) which can be adjusted outside the pump housing (8).

4. A distributor-type fuel injection pump according to claim 2, in which a Bowden cable (39) is used as an adjustment transmission element between adjusting element (41, 49) and idling lever (35), and a leg spring (40) engages the idling lever (35) in a direction of a smaller injected quantity.

5. A distributor-type fuel injection pump according to claim 3, in which a Bowden cable (39) is used as an adjustment transmission element between adjusting element (41, 49) and idling lever (35), and a leg spring (40) engages the idling lever (35) in a direction of a smaller injected quantity.

6. A distributor-type fuel injection pump according to claim 2, in which an electromagnet (41) is used as an adjusting element.

7. A distributor-type fuel injection pump according to claim 3, in which an electromagnet (41) is used as an adjusting element.

8. A distributor-type fuel injection pump according to claim 4, in which an electromagnet (41) is used as an adjusting element.

9. A distributor-type fuel injection pump according to claim 5, in which an electromagnet (41) is used as an adjusting element.

10. A distributor-type fuel injection pump according to claim 2, in which a barometric cell (49) operated by control air which is at a particular operating pressure is used as an adjusting element.

11. A distributor-type fuel injection pump according to claim 3, in which a barometric cell (49) operated by control air which is at a particular operating pressure is used as b adjusting element.

12. A distributor-type fuel injection pump according to claim 4, in which a barometric cell (49) operated by control air which is at a particular operating pressure is used as an adjusting element.

13. A distributor-type fuel injection according to claim 5, in which a barometric cell (49) operated by control air which is at a particular operating pressure is used as an adjusting element.

14. A distributor-type fuel injection pump according to claim 10, in which a negative pressure exists as operating pressure.

15. A distributor-type fuel injection pump according to claim 11, in which a negative pressure exists as operating pressure.

16. A distributor-type fuel injection pump according to claim 12, in which a negative pressure exists as operating pressure.

17. A distributor-type fuel injection pump according to claim 13, in which a negative pressure exists as operating pressure.

18. A distributor-type fuel injection pump according to claim 10, in which a solenoid valve (54) is arranged in the feed line (53) of the control air.

19. A distributor-type fuel injection pump according to claim 14, in which a solenoid valve (54) is arranged in the feed line (53) of the control air.

20. A distributor-type fuel injection pump according to claim 6, in which a circuit, in which at least two switches (44, 45) arranged in parallel and operated by operating characteristics (47, 48) are present for controlling the exciter current for solenoid (41) or solenoid valve (54) of the adjusting element (41, 49).

21. A distributor-type fuel injection pump according to claim 10, in which a circuit, in which at least two switches (44, 45) arranged in parallel and operated by operating characteristics (47, 48) are present for controlling the exciter current for solenoid (41) or solenoid valve (54) of the adjusting element (41, 49).

22. A distributor-type fuel injection pump according to claim 14, in which a circuit, in which at least two switches (44, 45) arranged in parallel and operating by operating characteristics (47, 48) are present for controlling the exciter current for solenoid (41) or solenoid valve (54) of the adjusting element (41, 49).

23. A distributor-type fuel injection pump according to claim 18, in which a circuit, in which at least two switches (44, 45) arranged in parallel and operated by operating characteristics (47, 48) are present for controlling the exciter current for solenoid (41) or solenoid valve (54) of the adjusting element (41, 49).

24. A distributor-type fuel injection pump according to claim 20, in which one switch (45) is closed when the engine is cold and is opened when the engine is hot in dependence on the cooling-water temperature of the engine.

25. A distributor-type fuel injection pump according to claim 20, in which the switch (44) can be closed when an additional unit (air-conditioning system) is placed into operation.

* * * * *